US009326365B2

(12) United States Patent
Karim et al.

(10) Patent No.: US 9,326,365 B2
(45) Date of Patent: Apr. 26, 2016

(54) CIRCUIT FOR FLASH LAMP

(71) Applicant: Xenon Corporation, Wilmington, MA (US)

(72) Inventors: Rezaoul Karim, Medford, MA (US); Saad Ahmed, Wilmington, MA (US)

(73) Assignee: Xenon Corporation, Wilmington, MA (US)

( * ) Notice: Subject to any disclaimer, the term of this patent is extended or adjusted under 35 U.S.C. 154(b) by 680 days.

(21) Appl. No.: 13/631,021

(22) Filed: Sep. 28, 2012

(65) Prior Publication Data

US 2013/0099693 A1 Apr. 25, 2013

Related U.S. Application Data

(60) Provisional application No. 61/549,418, filed on Oct. 20, 2011.

(51) Int. Cl.
*H05B 41/30* (2006.01)
*H05B 41/32* (2006.01)
*H05B 41/392* (2006.01)

(52) U.S. Cl.
CPC ..... *H05B 41/32* (2013.01); *H05B 41/3928* (2013.01)

(58) Field of Classification Search
USPC ..... 315/224, 84.51, 84.61, 209
See application file for complete search history.

(56) References Cited

U.S. PATENT DOCUMENTS

| | | | | |
|---|---|---|---|---|
| 3,864,600 | A * | 2/1975 | Schneider | 315/241 P |
| 3,909,667 | A * | 9/1975 | Decker | 315/241 P |
| 4,298,826 | A * | 11/1981 | Nakayama | 315/151 |
| 4,635,123 | A * | 1/1987 | Masunaga et al. | 348/299 |
| 2007/0200436 | A1 | 8/2007 | Barak | |
| 2008/0033413 | A1 | 2/2008 | Inochkin et al. | |
| 2008/0067946 | A1 | 3/2008 | Simonsen et al. | |
| 2008/0174252 | A1 * | 7/2008 | Mertens et al. | 315/290 |

FOREIGN PATENT DOCUMENTS

KR 10-2006-0124596 12/2006

OTHER PUBLICATIONS

International Search Report and Written Opinion for International Application No. PCT/US2012/058036 mailed Feb. 1, 2013. 10 pages.

* cited by examiner

*Primary Examiner* — Douglas W Owens
*Assistant Examiner* — James H Cho
(74) *Attorney, Agent, or Firm* — Wilmer Cutler Pickering Hale and Dorr LLP

(57) ABSTRACT

A circuit for a gas discharge system includes a pulse forming circuit, a discharge lamp, a circuit for recovering energy from the discharge lamp when a trigger to the lamp is turned off, a high voltage switch between the lamp and ground, and a two-part dissipating circuit across the switch. The system can provide a flat response with highly controllable pulse width.

21 Claims, 9 Drawing Sheets

IGBT Controlled Discharge Circuit for Discharge Lamps

CIRCUIT FOR FLASH LAMP

PRIORITY

This application claims priority to U.S. Provisional Application No. 61/549,418, filed Oct. 20, 2011. The entire contents of that application are incorporated herein by reference.

BACKGROUND

This disclosure relates to systems and methods for operating flash lamps, particularly controlling the properties of high energy pulses produced by flash lamps.

Flash lamps (also called discharge lamps) are operated with a trigger circuit to provide a pulse of light, which can include visible, ultraviolet (UV), and infrared (IR) radiation. A flash lamp is an electric arc lamp that produces intense, incoherent radiation for short pulse widths (durations). Flash tubes are typically made of a glass (e.g., quartz or borosilicate glass) envelope that can be linear, helical, U-shaped, or have some other shape. Electrodes are provided at either end. The envelope is filled with a gas that, when triggered, ionizes and conducts a high energy pulse to produce the light. Flash tubes are used in a wide variety of applications, including sintering, sterilizing, solar simulators, and curing.

DESCRIPTION

Figure 1:
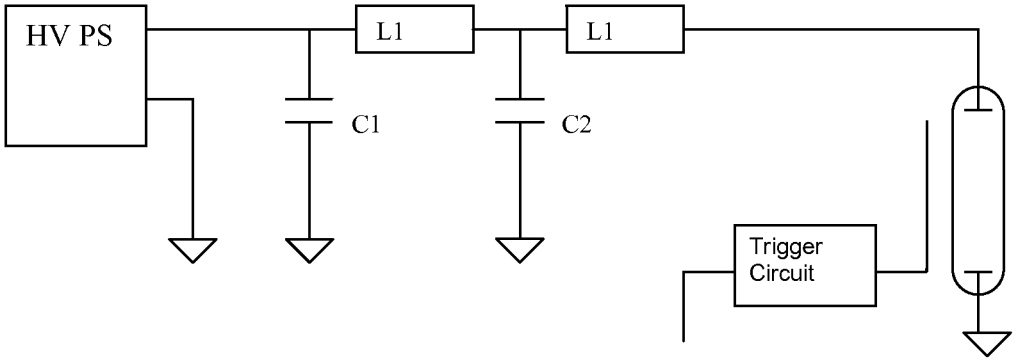
FIG. 1 (Prior Art)
FIGS. 1-4 illustrate known systems for controlling flash lamps.

FIG. 1 illustrates a system for controlling a flash lamp system having a high voltage power supply coupled to an LC circuit. This type of system has no control mechanism other than the control that activates the power supply and the trigger circuit. The energy in the LC circuit (L1, C1, and C2) creates a pulse that keeps dissipating until the energy in the LC circuit is discharged.

Figure 2:
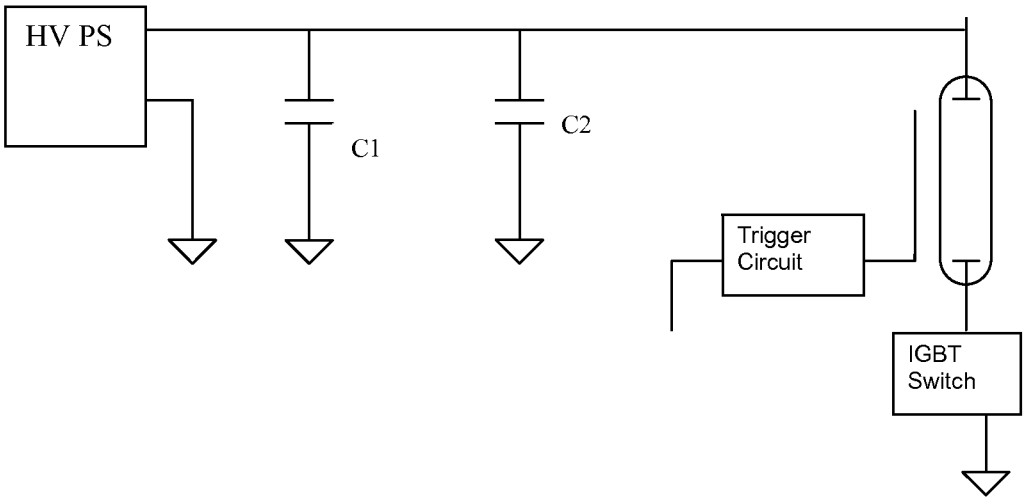
FIG. 2 (Prior Art)

FIG. 2 illustrates a system for controlling a flash lamp in which capacitors C1 and C2 are used to store energy. A high power switch, such as an insulated-gate bipolar transistor (IGBT) switch, is coupled between the lamp and ground. The switch can be opened and closed to try to control the pulse width.

Figure 3:
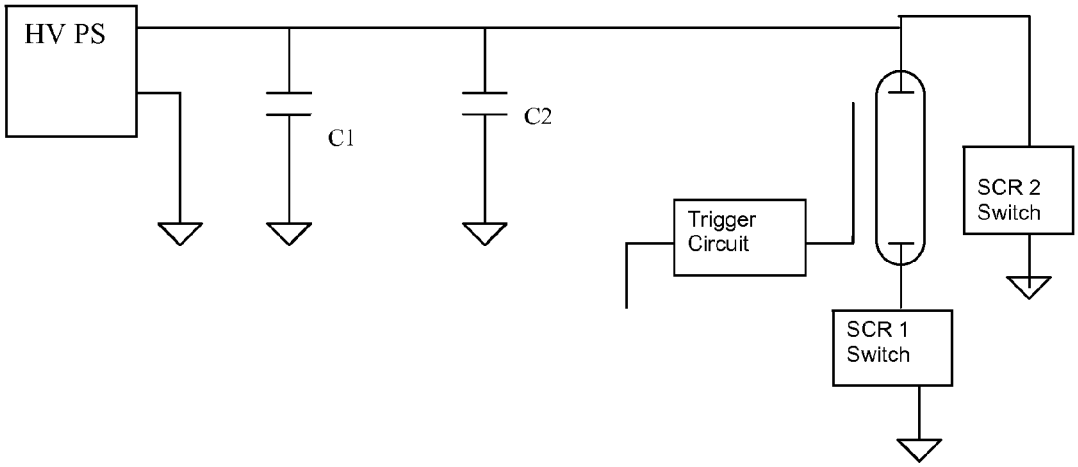
FIG. 3 (Prior Art)

FIG. 3 illustrates a variation of the system illustrated in FIG. 2, where the switch to ground is a silicon controlled rectifier (SCR) in series with the lamp. A second SCR switch is coupled in parallel to the lamp. When the second SCR is turned on, the lamp is switched off and all of the energy stored in capacitors C1 and C2 is dissipated.

Figure 4:
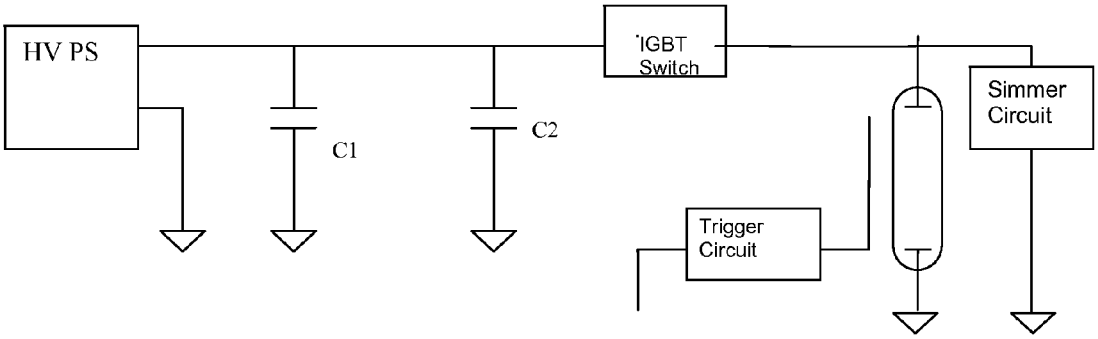
FIG. 4 (Prior Art)

FIG. 4 illustrates a system for controlling a flash lamp that uses an IGBT switch between the power supply and the lamp circuit. This system has a circuit referred to here as a simmer circuit in parallel between the lamp and ground. The lamp is turned on with low current from the simmer circuit, then the pulse is used with high current.

Figure 5:
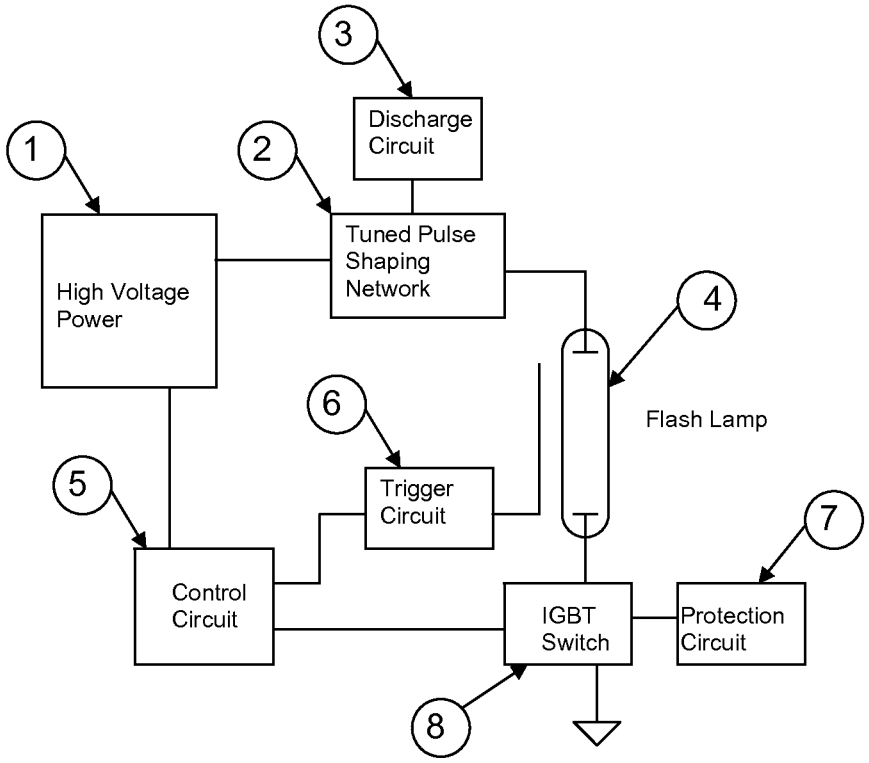
FIG. 5 is a block diagram of a flash lamp system in accordance with some embodiments.

FIG. 5 illustrates a system for controlling a flash lamp in accordance with some embodiments of the present disclosure. A high voltage power supply (1) powers a tuned pulse shaping network (2) that has a network of inductors, capacitors, and resistors for providing a pulse of radiation with a current profile that is flat in the time domain for a desired duration of the pulse of energy flowing through a flash lamp (4). A discharge circuit (3) may be used to safely remove (dissipate) stored energy from the tuned pulse shaping network (e.g., from an inductor) and store that energy in a capacitor. The lamp may be coupled to ground via an insulated-gate bipolar transistor (IGBT) switch (8) that is used to turn off current flow through the flash lamp (4). A protection circuit (7) connected across the IGBT switch may be used to help prevent damage to the IGBT switch by absorbing the energy generated in switching the lamp. A trigger circuit (6) may be used to bring the flash lamp into conduction. The high voltage power supply, the discharge circuit, the trigger circuit, and IGBT switch may be controlled by a control circuit (5).

Figure 6:
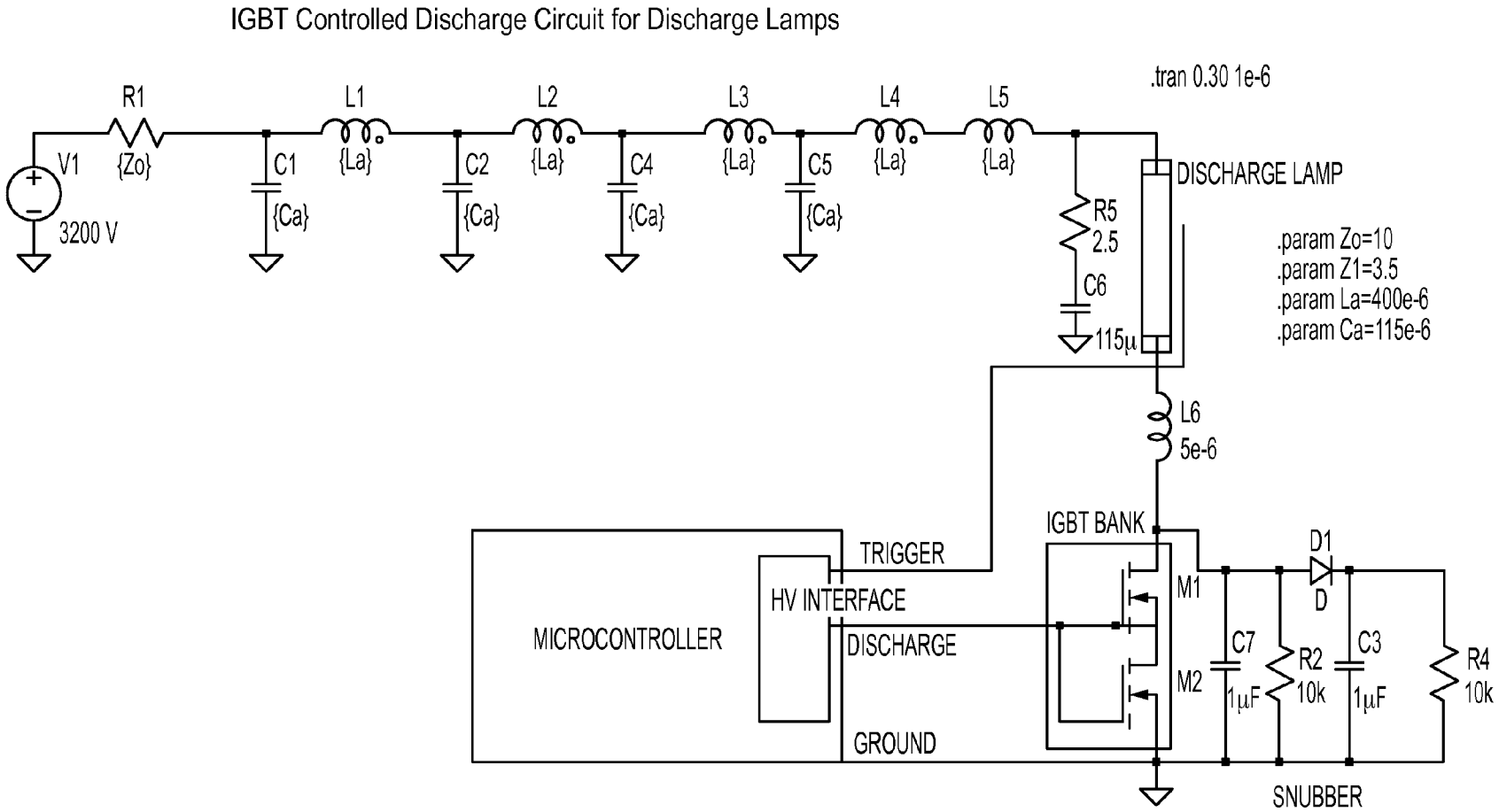
FIG. 6 is a schematic of a circuit for use with a flash lamp system in accordance with some embodiment.

FIG. 6 illustrates an example of an embodiment of the system of FIG. 5. A high voltage power supply may have a voltage such as 3200 volts. An RLC circuit including a resistor R1, capacitors C1, C2, C4, and C5, and inductors L1, L2, L3, L4, and L5 form a pulse forming network to provide a pulse with a desired current level. The taps between R1 and L1; L1 and L2; L2 and L3; and L3 and L4 can be used for providing different maximum pulse widths.

When it is desired to turn off the current in the lamp, a switch with one or more IGBTs can be opened. When this happens, the inductor/capacitor network (e.g., C1, C2, C4, C5, L1, L2, L3, L4, and L5) tries to continue to provide current. This action can result in a voltage spike that could cause the IGBT switch to fail. To address this, the circuit network is provided with resistor R5 and capacitor C6. Resistor R5 has a value that is selected to shape the pulse to prevent current and voltage spikes in the pulse.

In some embodiments, resistor R5 may have a resistance of about 2.5 ohms. In other embodiments, the resistor may have a resistance that is between about 1 ohm and 10 ohms, and may be between about 2-3 ohms, or with some other resistance depending on other circuitry and impedance of the lamp. When the IGBT turns off, some of the energy from the pulse forming network is provided to capacitor C6 where it can be stored and later provided to the flash lamp, thus saving energy. Some of the unused energy will also remain in the LC network (C1, C2, C4, C5, L1, L2, L3, L4, L5). Thus, most of the unused energy is saved rather than being shunted to ground. In some embodiments, the capacitance of C1, C2, C4, and C5 are equal and the capacitance of C6 approximately equals that of C1. In other embodiments, the inductance of L1, L2, L3, L4, and L5 are equal. In some embodiments, the resistance of R5 approximately equals the impedance of the flash lamp.

This circuit also allows fast recharge and thus reduced time between pulses. As the capacitors may not be fully discharged during a short pulse, proportionately less time may be used to re-charge them. In some embodiments, pulse rates of at least 2 pulses per second with a pulse duration of at least 1 millisecond may be possible. In other embodiments, pulse rates of at least 20 pulses per second with a duration of at least 0.1 milliseconds may be possible.

From the flash lamp to ground, there may be an IGBT switch, or bank of switches, and a circuit, referred to here as a snubber circuit, that may have two stages of dissipation. When the IGBT switch is opened, the energy from the lamp quickly starts to dissipate into the RC network of resistor R2 and capacitor C7. A second RC circuit includes diode D1, capacitor C3, and resistor R4. A second stage of dissipation occurs after the diode turn on time. In some embodiments, the diode turn on time may be about 3 microseconds. This two-portion snubber circuit (also called a dissipating circuit or a protection circuit) allows some immediate dissipation and then longer term dissipation without a high capacitance in capacitor C7.

The circuitry that is illustrated as part of the snubber circuit of FIG. 6 is in accordance with some embodiments. Other embodiments may include a different number of other resistors, capacitors, and active devices arranged differently.

A microcontroller may control the voltage source (connection not shown), have a trigger line for triggering the flash lamp, and have a discharge line allowing the switch to be opened and closed.

Figure 9:
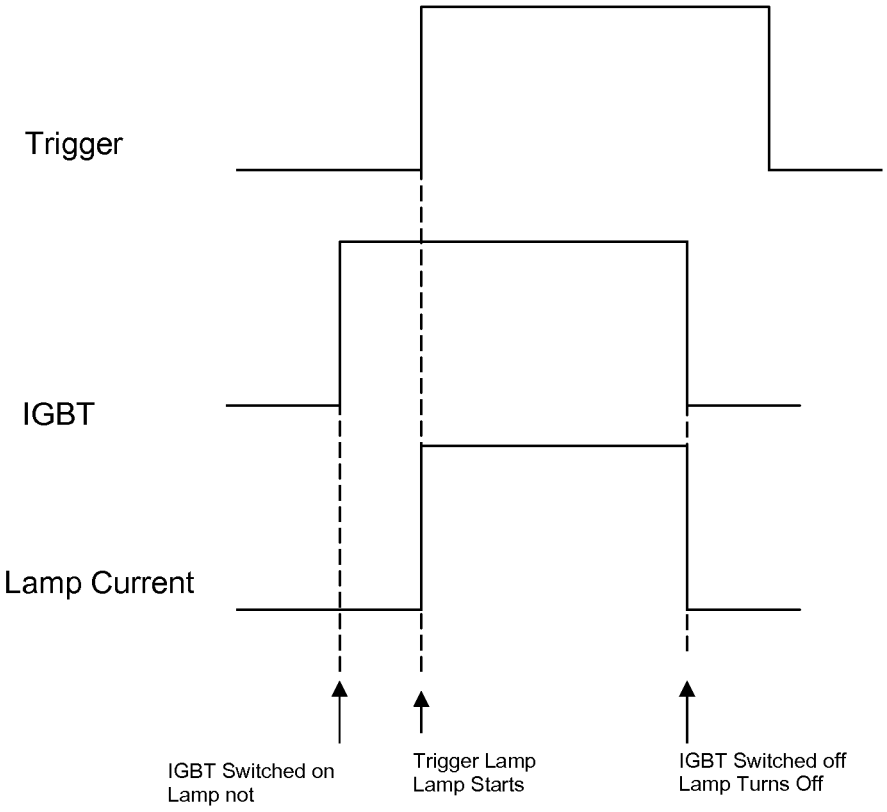
FIG. 9 is a timing diagram of a flash lamp system in accordance with some embodiments.

FIG. 9 is a timing diagram of a flash lamp system in accordance with some embodiments. Referring to FIG. 9, the IGBT switch is initially turned on (i.e., closed). After the IGBT is closed, the trigger is turned on to start the pulse in the flash lamp. This trigger starts the lamp current, which remains on until IGBT switch is switched off (i.e., opened) and then lamp turns off. After the lamp turns off, the trigger control can turn off the trigger.

After the trigger turns on, there is often some level of jitter when the energy from the lamp forms. This jitter may be caused by the geometry of the lamp, the gases in the lamp, and other random factors. The microcontroller can monitor the current in the lamp and cause the IGBT switch to be opened at a desired time after the increase in current is sensed. This feedback control allows the pulse width to be controlled in response to the conditions one pulse at a time and in a way that overcomes jitter. Alternatively, the switch can be opened and closed at a same constant time for every pulse.

Figure 7:
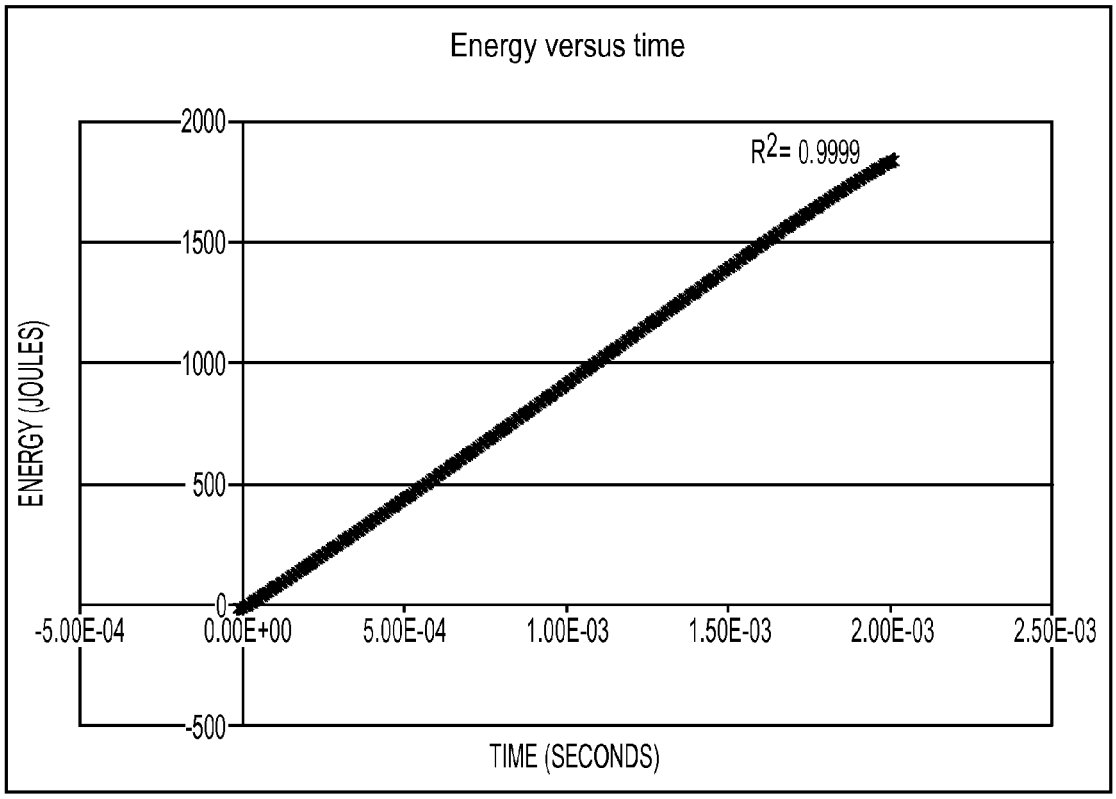
FIGS. 7-8 are graphs showing pulse shape and energy in accordance with some embodiments.
Figure 8:
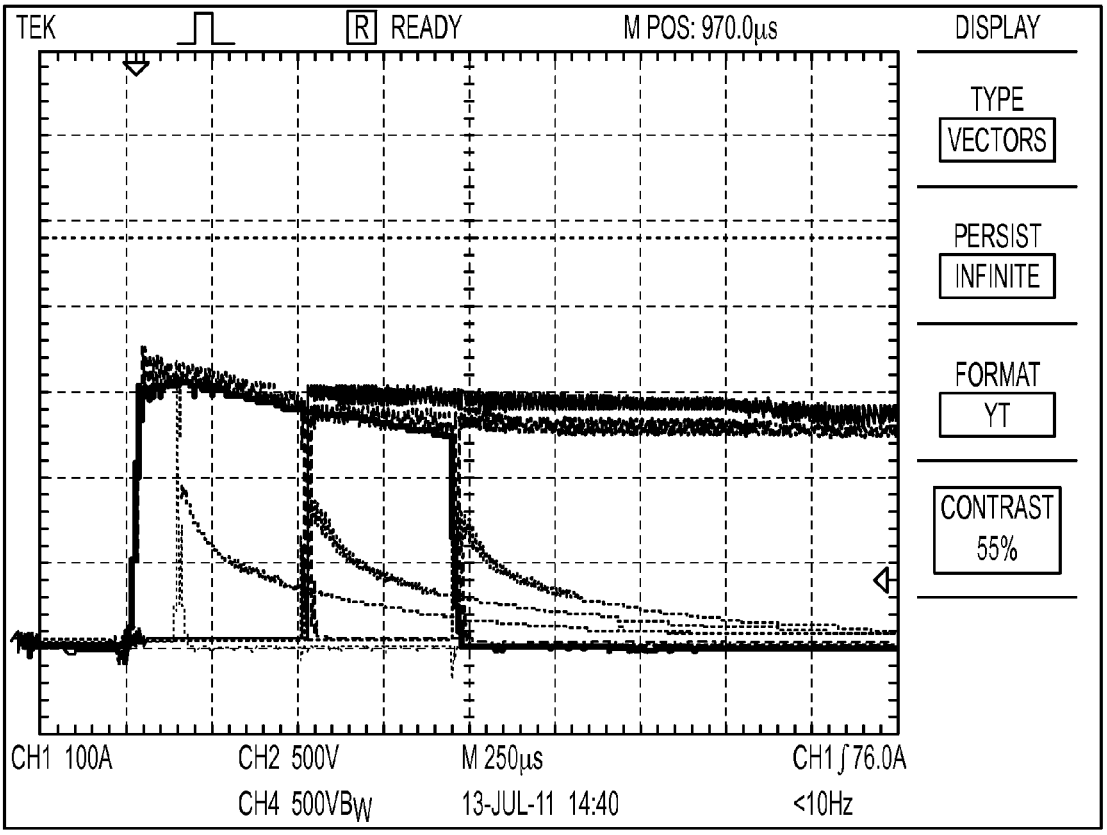

FIGS. 7 and 8 show examples of flash lamp pulse energy levels and the linearity of the pulse energy versus time. As shown in FIG. 8, there is no substantial energy spike at the beginning of the pulse. Furthermore, the pulse has a fairly flat energy level for its duration. As a result, the energy over time, as represented in FIG. 7, is linear because the relationship of energy over time is based on the integral of the pulse of the type shown in FIG. 8. By adding a substantially flat response in the time domain, the energy versus time can be characterized in a linear manner. It is desired, for example, for the curve to be linear with an $R^2$ value greater than 0.99. In the example shown in FIG. 7, the $R^2$ value equals 0.9998.

In other embodiments, a multitude of series and parallel IGBTs may be coupled together to accommodate the high voltages and current used by some flash lamps. Typical voltages that are used in flash lamps range, for example, from 1500 to 3000 V. Pulse currents range, for example, between 200 to 700 A. Typical pulse widths may vary by application type. For example, in embodiments using a flash lamp for sintering applications, an IGBT may sustains these power levels for typical pulse durations ranging from 100 to 2000 microseconds. In other embodiments used for testing solar panels, pulse widths may range from 100 to 200 milliseconds. Synchronization of the timing for the trigger circuit and the IGBT switch may determine the pulse duration. The IGBT protection circuit is used to prevent damage to IGBT from inductive energy stored within the tuned pulse shaping network and the flash lamp.

The control circuit can allow the user to set the desired pulse voltage, period, and pulse width from one pulse to the next. Additionally the microcontroller may be able to vary the pulse width from one pulse to the next and thus allow for different energy to be deposited per pulse. Additionally, the microcontroller can limit the user to pulse widths and energies that do not violate the operational limits of the lamp, the high voltage supply, and the IGBT switch. The term microcontroller or processor is intended broadly to include any form of logic that can be used to provide control to the system, including microprocessors, microcontrollers, application-specific circuitry, or any other suitable device that can provide control of turning on and off lines and connections in response to feedback.

The tuned pulse shaping network can include components that are selected for a specific type of flash lamp. By such selection, the pulse profile can be made flat for as much of the possible duration of the pulse as reasonably possible.

The system can be used to provide fine control of the pulse from one pulse to the next. In some embodiments, the control may allow a first pulse that has duration such as 2,000 microseconds or less, followed less than a second later by a second pulse that has some different selected pulse width. Because of the well-characterized linear relationship of energy versus time, the amount of energy can be carefully controlled by controlling pulse duration. This level of control allows for more convenient operation in systems in which it is desired to have two or more steps in the processing of a work piece, such as a system which uses a high energy pulse followed by a low energy pulse, or a low energy pulse followed by a high energy pulse. In some embodiments used with conductive ink, a low energy pulse could be used first to drive off solvents, and a higher energy pulse could be used to sinter conductive ink, as described, for example, in U.S. Provisional Application No. 61/524,091.

The systems and methods described here can provide one or more of the following advantages. One potential advantage is that switching off the mechanism saves unused energy within a tuned pulse shaping network, allowing it to be used for subsequent pulses. Another potential advantage to having a flat response is that the spectrum of light from the flash lamp (which is current dependent) is also accurately controlled. This can lead to higher efficiencies in the process. An additional benefit of a flat response is that the possibility of IGBTs experiencing spikes that can cause damage is reduced.

This system can provide an accurate pulse profile to a flash lamp where both pulse width and amplitude can be precisely adjustable. An additional goal of this system is to provide a linear relationship between the pulse width and the energy radiated by the flash lamp.

Having described embodiments of the present invention, it should be apparent that modifications can be made without departing from the scope of the inventions described herein. The system can be used in conjunction with other circuits and lamps.

What is claimed is:

1. A pulsed lamp system comprising:

a pulsed gas discharge lamp for connection to a power source, the pulsed gas discharge lamp enclosing a gas that, when triggered, ionizes and conducts a high energy pulse;

a switch coupled between the pulsed gas discharge lamp and ground; and a microcontroller for:

(a) closing the switch, (b) after a desired time, triggering the turning on a trigger for the pulsed gas discharge lamp, and (c) after the trigger and after a desired pulse width time to deliver a pulse with high energy, opening the switch, wherein the microcontroller is configured to monitor a current level of the pulsed gas discharge lamp and, in response to the monitoring, causes the switch to open at a predetermined time after sensing an increase of the current level.

2. The pulsed lamp system of claim 1, further comprising an RLC circuit coupled in series with the pulsed gas discharge lamp, and a circuit including a resistor and a capacitor in parallel with the pulsed gas discharge lamp, the capacitor for storing energy when the switch is opened.

3. The pulsed lamp system of claim 2, wherein the resistor has a resistance of about 1 ohm to about 10 ohms.

4. The pulsed lamp system of claim 1, further comprising a discharge circuit in parallel with the switch, wherein the discharge circuit includes a first capacitor in parallel with the switch, and a second capacitor and a diode in series, the second capacitor and diode being in parallel with the switch and with the first capacitor.

5. The pulsed lamp system of claim 1, wherein the pulse is linear with an R-squared value of at least 0.99.

6. The pulsed lamp system of claim 1, wherein the microcontroller is configured to provide multiple pulses, at least two of which have a different desired pulse width, within a one second period of time.

7. The pulsed lamp system of claim 1, wherein the switch includes an insulated-gate bipolar transistor (IGBT) switch.

8. A system comprising:

a pulsed gas discharge lamp for connection to a power source, the pulsed gas discharge lamp enclosing a gas that, when triggered, ionizes and conducts a high energy pulse;

a pulse forming circuit coupled between the power source and the pulsed gas discharge lamp;

a switch coupled between the pulsed gas discharge lamp and ground; and an RC circuit in parallel with the pulsed gas discharge lamp, the RC circuit including a capacitor that absorbs inductive current when the switch is opened after the pulsed gas discharge lamp has been discharging, wherein the pulse forming circuit includes capacitors and the pulse forming circuit and the RC circuit are each configured to store unused energy when the switch is opened and the capacitors are not fully discharged.

9. The system of claim 8, wherein the pulse forming circuit includes a network of inductors, capacitors, and resistors.

10. The system of claim 8, wherein the RC circuit causes the pulse received by the pulsed gas discharge lamp to have a linear energy-to-time profile.

11. The system of claim 10, wherein the linear energy-to-time profile has an R-squared value greater than 0.99.

12. The system of claim 8, wherein the RC circuit includes a resistor with an impedance approximately equal to the impedance of the pulsed gas discharge lamp.

13. The system of claim 12, where the resistor has a resistance about 1 ohm to about 10 ohms.

14. The system of claim 8, wherein the RC circuit stores energy from the pulse forming circuit when the switch is opened such that the energy is later used by the discharge lamp, thereby allowing multiple pulses in rapid succession.

15. The system of claim 14, wherein the multiple pulses in rapid succession occur at least twice per second and at least two of the pulses have different pulse durations.

16. The system of claim 15, wherein the multiple pulses in rapid succession occur at least twenty times per second.

17. A system comprising:

a pulsed gas discharge lamp for connection to a power source, the pulsed gas discharge lamp enclosing a gas that, when triggered, ionizes and conducts a high energy pulse;

a pulse forming circuit coupled between the power source and the pulsed gas discharge lamp;

a switch coupled between the pulsed gas discharge lamp and ground;

a protection circuit coupled with the switch and including:

a first capacitor coupled in parallel with the switch, wherein the first capacitor dissipates energy when the switch is opened after the pulsed gas discharge lamp has been discharging; and a second capacitor coupled in parallel with the switch, and a diode coupled between the switch and the second capacitor, wherein the diode permits current to flow through the second capacitor after the diode turns on and the second capacitor thereby discharges energy when the switch is open after the pulsed gas discharge lamp has been discharging.

18. The system of claim 17, further comprising a first resistor coupled in parallel with the first capacitor, and a second resistor coupled in parallel with the second capacitor.

19. The system of claim 18, wherein a resistance of the first resistor and a resistance of the second resistor are about the same, and a capacitance of the first capacitor and a capacitance of the second capacitor are about the same.

20. The system of claim 17, wherein the diode turn-on time is approximately 3 microseconds.

21. The system of claim 17, wherein the high voltage switch includes an IGBT switch.

* * * * *